US006044929A

United States Patent [19]

Wishner

[11] Patent Number: 6,044,929

[45] Date of Patent: Apr. 4, 2000

[54] LADDER LEVELING DEVICE

[76] Inventor: David Matthew Wishner, 75 Roton Ave., Rowayton, Conn. 06853

[21] Appl. No.: 09/238,195

[22] Filed: Jan. 27, 1999

[51] Int. Cl.[7] ..... E06C 1/00

[52] U.S. Cl. ..... 182/200; 182/202; 248/188.2; 248/188.4

[58] Field of Search ..... 182/200, 180.2, 182/170, 202, 204, 201, 107; 248/188.2, 188.3, 188.4

[56] References Cited

U.S. PATENT DOCUMENTS

| | | | |
|---|---|---|---|
| D. 359,366 | 6/1995 | Spevak | D25/68 |
| 3,520,506 | 7/1970 | Szohatzky et al. | 248/188.2 |
| 3,993,275 | 11/1976 | Lucas | 248/188.2 |
| 4,014,406 | 3/1977 | Easton | 182/204 |
| 4,054,103 | 10/1977 | Gabriel | 182/139 X |
| 4,069,893 | 1/1978 | Blackstone | 182/200 |
| 4,095,671 | 6/1978 | Forristall et al. | 182/202 |
| 4,243,122 | 1/1981 | Coutts | 182/200 |
| 4,456,095 | 6/1984 | Hodson | 182/200 |
| 4,673,061 | 6/1987 | Zeiset | 182/202 |
| 4,683,982 | 8/1987 | Baker | 182/204 |
| 4,683,983 | 8/1987 | Murphy | 182/204 |
| 4,687,075 | 8/1987 | Skaggs | 182/121 |
| 4,699,247 | 10/1987 | Clarke | 182/200 X |
| 4,799,573 | 1/1989 | Simnovec et al. | 182/2 |
| 5,325,936 | 7/1994 | Baker | 182/204 |
| 5,339,921 | 8/1994 | Faupel | 182/200 X |
| 5,341,899 | 8/1994 | Casamento | 182/205 |
| 5,615,752 | 4/1997 | Wassil | 182/200 |
| 5,669,462 | 9/1997 | Jennings | 182/111 |
| 5,771,992 | 6/1998 | Snyder | 182/200 |
| 5,791,438 | 8/1998 | Kempton | 182/200 |

*Primary Examiner*—Daniel P. Stodola
*Assistant Examiner*—Hugh B. Thompson

[57] ABSTRACT

A ladder leveling device that is free-standing and is not installed, or fixed to, the existing ladder (80). Simple, one-person operation of device provides quick convenient way to establish a level and stable work surface over non-level ground, allowing the safe mounting of most common ladders onto device frame (10). Trough (12) provides safe and secure positioning of ladder on top of leveled device. Range of device support, leg (25), adjustment is adequate to provide for safe use on common residential stairs. Infinite adjustment of supports allows precise leveling. Inclinometer (40) displays precise, accurate device-leveling information for safety and ease of operation. All-terrain footing devices (30) provide sturdy use on various ground types.

8 Claims, 4 Drawing Sheets

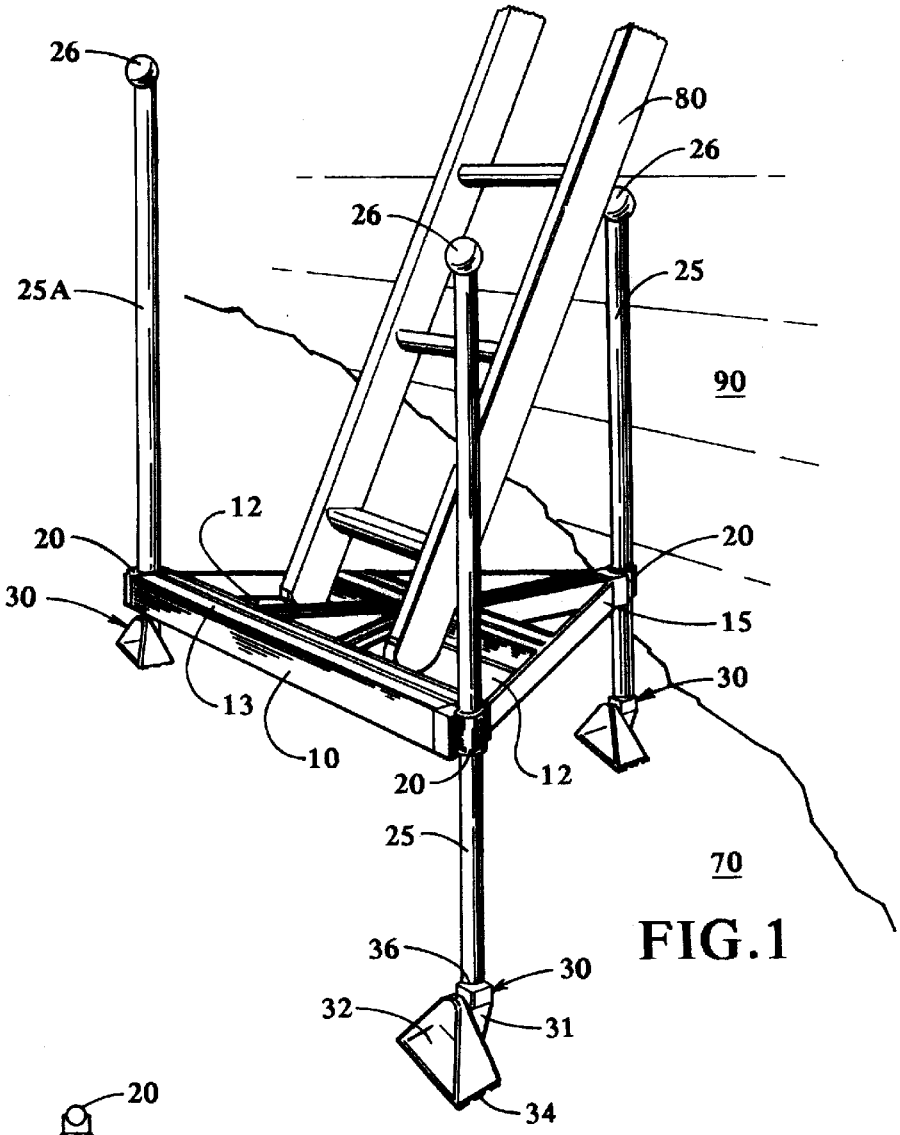
FIG.1
FIG.1A
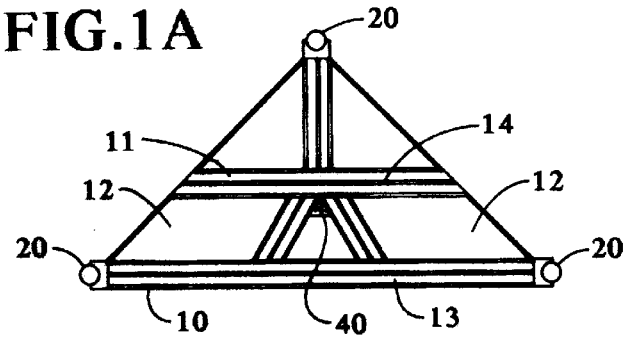

LADDER LEVELING DEVICE

FIELD OF THE INVENTION

The present invention pertains generally to ladder leveling devices, specifically to ladder leveling devices that are not attached to the ladder, and that are used to level the ground under the ladder.

DESCRIPTION OF THE PRIOR ART

Numerous ladder leveling devices have been provided in prior art. While these devices may support their claims, they are different in principle from the present invention as subsequently described.

U.S. Pat. No. 5,669,462, to Jennings (1997), along with U.S. Pat. No. 4,683,983 to Murphy (1987); U.S. Pat. No. 4,852,689 to Erion (1989); U.S. Pat. No. 5,094,320 to Deitz and Spector (1992); U.S. Pat. No. 4,673,061 to Zeiset (1987); U.S. Pat. No. 4,456,095 to Hodson (1984); and U.S. Pat. No. Des. 359,366 to Spevak (1995), disclose ladder leveling devices that are fixed, to existing ladders. Although possibly effective ladder leveling devices, they all require time-consuming installation or adaptation to the existing ladder. Some examples of the prior art listed above further requires that the ladder be erected before ensuring the leveling adjustment is correct, which is also time-consuming, and unsafe.

Prior art, such as Jennings, U.S. Pat. No. 5,669,462 (1997), has incremental adjustments, thus reducing the precision of leveling adjustments.

Consequently, a need still exists for a ladder leveling device that is not attached to the ladder, so that the ladder-leveling device can be quickly set up for use, and precisely leveled, prior to mounting the ladder on to the ladder leveling device.

OBJECTS AND ADVANTAGES

The primary object of the ladder leveling device of the present invention is to provide for its user a quick, easy way of securely leveling a non-level ground area in order to make it safe to erect a common ladder, consisting of two parallel rails connected by multiple rungs. All encountered prior art effectively appends the existing ladder in an attempt to compensate for the uneven ground it is being erected upon. The present invention is unique in that it provides a sturdy, level base upon which a common ladder can be safely mounted. Thus eliminating the unsafe, yet common, practice of wedging rocks, wood, or like objects, underneath a common ladder rail in order to stabilize it during use on uneven ground.

An added object is to provide a ladder leveling device that has a range of adjustment adequate to ensure safe ladder use on common stairs (8 unit rise: 10 unit run), or an 80 percent horizontal grade.

Another added object is to provide a ladder leveling device that is easily used by a lone user.

Another added object is to provide a ladder leveling device that integrates an inclinometer to display accurate, current device-leveling information.

Another added object is to provide a ladder leveling device that incorporates an allterrain footing device, thereby allowing safe, effective use on hard and/or soft ground.

Further objects and advantages of the present invention will become apparent upon consideration of the ensuing description and drawings.

DRAWING FIGURES

FIG. 1 shows a ladder leveling device in perspective as viewed from the above-right-rear.

FIG. 1A shows a plan view of frame 10.

LIST OF REFERENCE NUMBERS

10 Frame, chassis, base-plate.
11 Work surface, upwardly-facing top side of frame 10.
12 Trough, recessed portion of frame 10.
13 Step, rear-most segment of frame 10.
14 Ribbing, non-slip texture to work surface 11.
15 Peak, front-most segment of frame 10.
20 Leg clamp, support clamp, adjustment head, threaded collar.
25 Leg, support, strut, threaded shaft.
25A Up-hill leg, up-hill support.
26 Leg, or support, adjuster.
30 All-terrain footing device.
31 Soft-ground foot.
32 Hard-ground foot.
33 Hard-ground foot pivot.
34 Hard-ground foot pad.
36 All-terrain footing device swivel.
40 Inclinometer, dual-axis level vials.
70 Ground.
70A Hard Ground.
70B Soft Ground.
80 Ladder, common extension type.
90 Working wall.

SUMMARY

A ladder leveling device of the present invention, comprising primarily of a frame with adjustable legs, provides a quick, easy way of securely leveling a non-level ground area, upon which a common ladder may be safely mounted.

DESCRIPTION OF THE INVENTION

Figure 2:
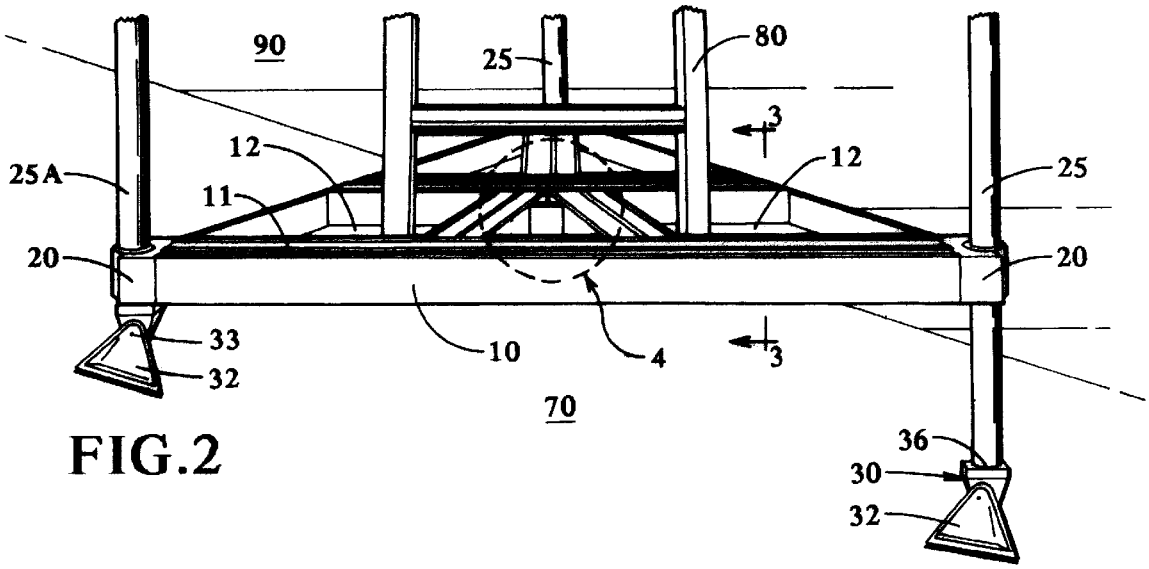
FIG. 2 shows a perspective detail view of work surface 11 as viewed from the rear of the invention.

FIG. 1 and FIG. 2 show a typical embodiment of a ladder leveling device of the present invention. Comprised primarily of main features frame 10 and legs 25, where frame 10 has the following four features: a work surface 11, a trough 12, an inclinometer 40, and leg clamps 20; and where legs 25 each feature: a leg adjuster 26 and an all-terrain footing device 30.

The shape of frame 10 shown in plan view, FIG. 1A, of the present invention is triangular, right-isosceles in proportion. Although other shapes or forms are readily conceivable, a triangular shape represents the simple geometrical theory that states that the minimum number of points necessary to form a plane, work surface 11, is three. Right-isosceles proportions exhibit inherent geometrical strength while creating ample area for the position and placement of ladder 80 in trough 12.

Work surface 11, the upwardly-facing plane of frame 10, is created, in the viewed embodiment of FIG. 1, FIG. 1A, and FIG. 2, by the alignment and fixation of extruded aluminum "C"-channel segments and cut aluminum sheet material. Other suitable materials and configurations may be used. Work surface 11 is textured in the viewed embodiment with ribbing 14, which produces a non-slip footing surface. Other suitable non-slip textures may be used.

Figure 3:
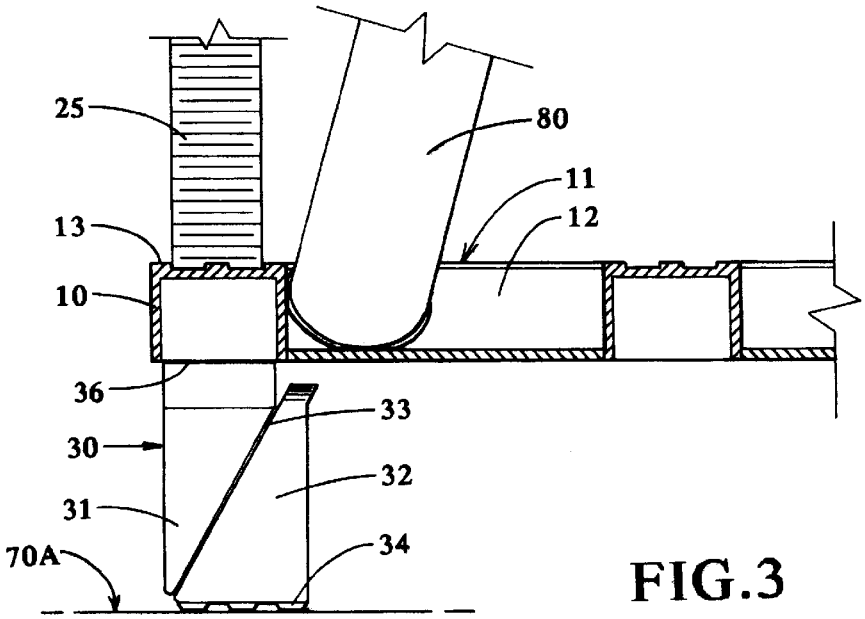
FIG. 3 shows a section detail of trough 12, as viewed from line 3—3 in FIG. 2.

Trough 12, as best illustrated in FIG. 3, is a recessed portion of work surface 11, formed by the connection of parallel "C"-channel segments, the rear-most being step 13, by non-tapering-width sheet material. Trough 12 and step 13 provide positive location and fixation of ladder 80 within frame 10.

Figure 4:
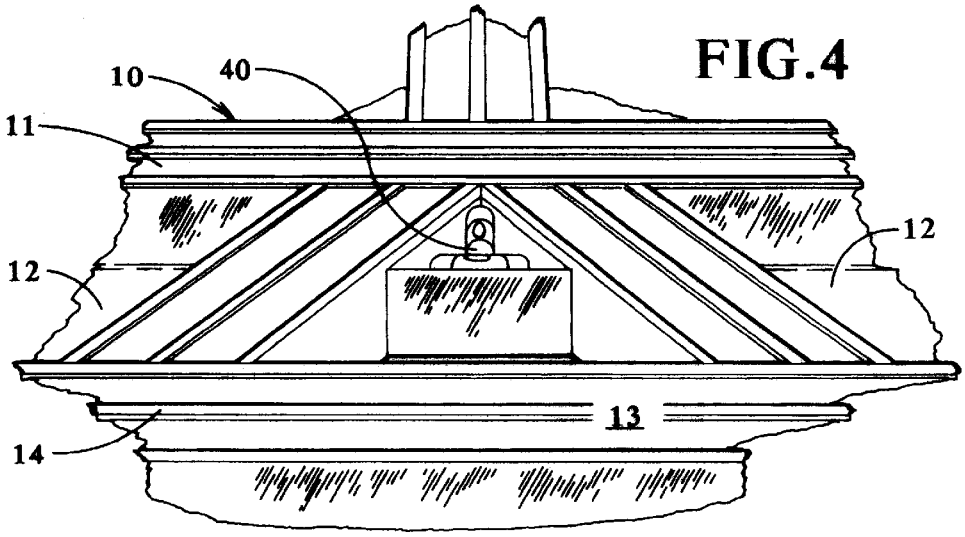
FIG. 4 shows an enlarged perspective view of the area indicated by arrow 4 in FIG. 2.

Inclinometer 40, which is best illustrated in its current embodiment in FIG. 4, is centrally located within frame 10. It is fixed so that its most upwardly portion is flush with work surface 11. Inclinometer 40 in the present embodiment is comprised of two common bubble vial-levels, as found in many current types of leveling devices and inclinometers. Other suitable types of inclinometers may be utilized. Fixed in a horizontal alignment, perpendicular to each other, so that one bubble vial indicates a level position of work surface 11 in front-rear, or pitch, axis; the second bubble vial indicates a level position of work surface 11 in side-side, or roll, axis.

Figure 5:
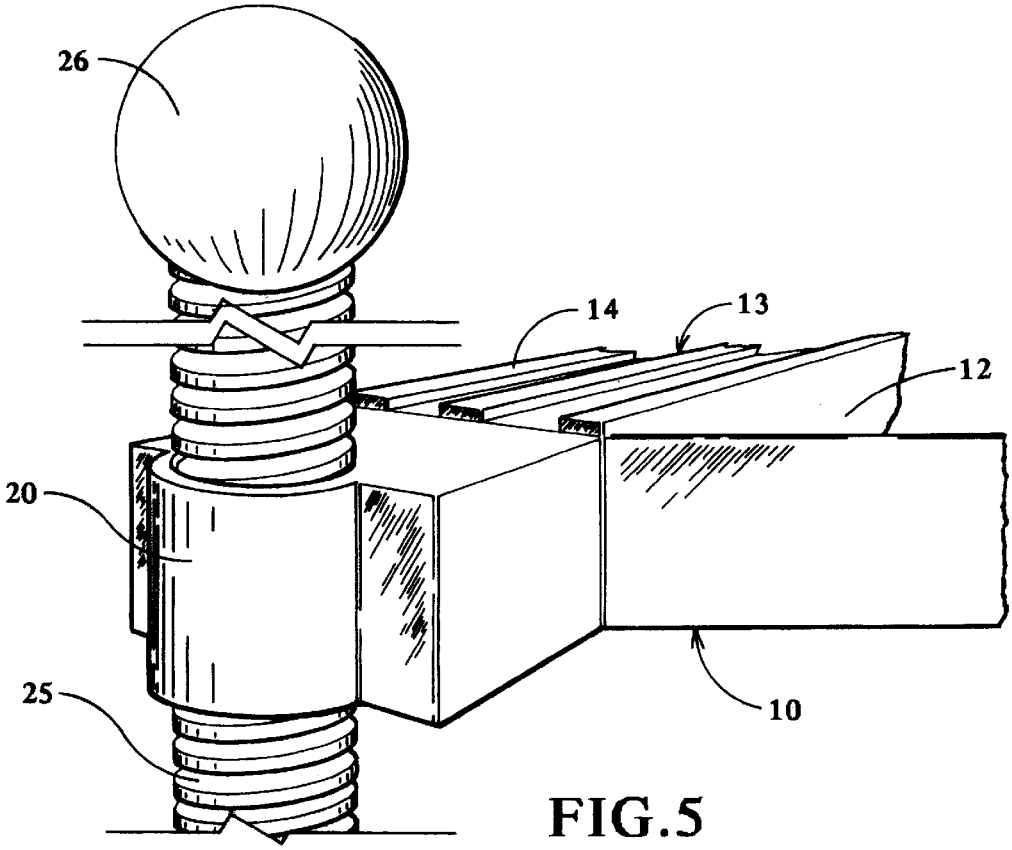
FIG. 5 shows a perspective detail view of leg clamp 20.

A typical example of leg clamp 20, with leg 25, is clearly shown in FIG. 5. Each horizontal planar extreme of frame 10, as shown in FIG. 1A, locates leg clamp 20, which is fastened mechanically, or by other suitable means, to frame 10. Each individual leg clamp 20 holds a respective leg 25, relatively perpendicular to horizontal plane of work surface 11. Each leg clamp 20 allows each leg 25 to independently travel along its length axis. In the present embodiment, this is accomplished using common mechanical screw principles, where leg 25, fabricated of aluminum or other suitable material, has external threads that complement the internal threads of leg clamp 20, fabricated of aluminum or other suitable material, although other capable mechanisms are possible. Actuated by the rotation of leg adjuster 26, which converts external forces into linear adjustment of position of leg 25. It its present embodiment, leg adjuster 26 is fixed to the vertically-upward end of leg 25, although other suitable means for adjustment of leg 25's linear position may be used. Leg clamp 20 is capable of fixing leg 25 in any position along its linear travel, thereby creating infinite work surface 11 planar adjustment. The length of leg 25 is such a length to allow work surface 11 to maintain a level plane on ground 70 that has an 80-percent horizontal grade (four unit rise: five unit run proportions), as experienced on most common residential staircases.

Figure 6:
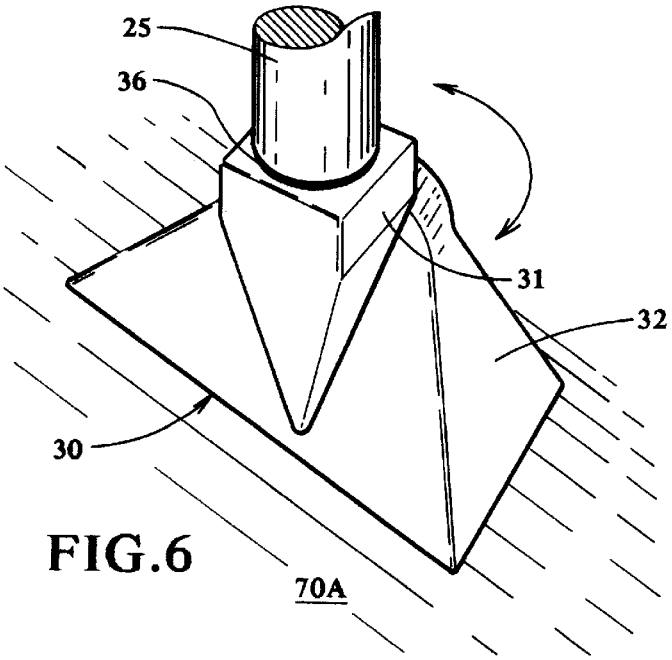
FIG. 6 shows a perspective detail view of all-terrain footing device 30 set for use on hard ground 70A.
Figure 7:
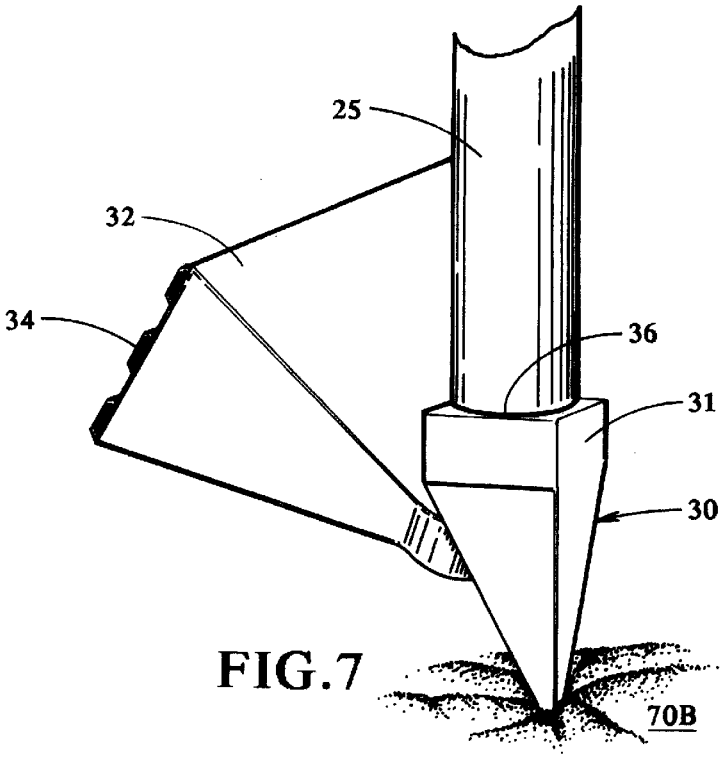
FIG. 7 shows a perspective detail view of all-terrain footing device 30 set for use on soft ground 70B.

The vertically-downward end of each leg 25, clearly shown in FIG. 6 and FIG. 7, incorporates an example of all-terrain footing device 30, fabricated of aluminum or other suitable material, coupled by all-terrain footing device swivel 36. In the present embodiment, each swivel 36, a simple axle-type joint, allows each all-terrain footing device 30 to pivot 360-degrees about the length axis of leg 25. Each all-terrain footing device 30 is comprised of soft-ground foot 31 and hard-ground foot 32, with hard-ground foot pad 34. Soft-ground foot 31 and hard-ground foot 32 are coupled by all-terrain foot pivot 33.

OPERATION OF INVENTION

In the following description, like reference characters designate like or corresponding parts throughout the several views of the accompanying drawings. Also, in the following description, it is to be understood that such terms as "forward", "rearward", "left", "right", "upwardly", "downwardly", and the like, are words of convenience and are not to be construed as limiting terms.

Referring to the accompanying drawings, particularly FIG. 1, where a typical embodiment of the present invention is shown in operation, frame 10 is oriented so that step 13 is parallel to working wall 90. And so that front 15 is closest in proximity to working wall 90. The distance between working wall 90 and front 15 should be such that when ladder 80 is mounted and in operating position it will be roughly 15 degrees from vertical/75 degrees from horizontal. Ground 70 is sloping downward to the viewed right, thereby making viewed left-most leg 25 a unique element, up-hill leg 25A. In other environments where the ground, or terrain, may slope in different directions, it is possible for any other leg 25 to be designated up-hill leg 25A. Maximum stability of a ladder leveling device in this typical embodiment is achieved when up-hill leg 25A is adjusted to its shortest setting, whereby work surface 11 is in as close of a proximity to ground 70 as possible.

Ground 70 compaction, hard ground 70A or soft ground 70B, as depicted in FIG. 6 and FIG. 7, respectively, will determine the optimal position of each hard ground foot 32 of each all-terrain footing device 30. When deploying a ladder leveling device of the present invention on hard ground 70A, hard-ground foot 32 is to be rotated about the axis of hard-ground foot pivot 33 so that hard-ground foot surface 34 is in a position to make optimal surface contact with hard ground 70A (FIG. 6). This adjustment will also be aided by the horizontal rotation of all-terrain footing device 30 about swivel 36. When deploying a ladder leveling device of the present invention on soft ground 70B, hard-ground foot 32 is to be rotated about the axis of hard-ground foot pivot 33 so that hard-ground foot surface 34 is in a position to allow soft-ground foot 31 to penetrate soft ground 70B (FIG. 7). When each all-terrain footing device 30 is adjusted so as to correspond its ground 70 compaction, and proper orientation of the ladder leveling device frame 10 is achieved, leveling of the device described can commence.

Leveling of the present invention in its depicted embodiment is easily achieved as follows: With each leg 25 adjusted to its shortest setting, so that all-terrain footing device 30 is as close to the underside of frame 10 as possible, all-terrain footing device 30 of up-hill leg 25A is placed in contact with ground 70. Holding frame 10 relatively level, as guided by the feedback provided by inclinometer 40, so that only up-hill leg 25A is maintaining contact with ground 70, rotate leg adjuster 26 of each suspended all-terrain footing device 30 until all of the all-terrain foot devices 30 contact ground 70.

When ladder leveling device frame 10 is maintaining an unaided level position, as indicated by satisfactory readings of inclinometer 40, slowly increase load, or weight, on top of work surface 11. Placing one foot on work surface 11, then slowly distributing weight to that foot, provides a safe way of determining stability of ground 70. Settling of ground 70 beneath the present invention under load will un-level frame 10 and will be immediately visualized through the readings of inclinometer 40. Appropriate rotations of leg adjuster 26 of legs 25 (up-hill leg 25A should always maintain lowest possible setting), will re-level frame 10, as indicated by satisfactory level readings of inclinometer 40. Re-leveling of frame 10 is repeated as often as necessary until frame 10 maintains a level position after work surface 11 is loaded with all operating weight, or representative mass.

After proper placement and orientation of ladder leveling device in relation to working wall 90, and after stable position and level adjustment of frame 10 is achieved, the bottom end, or feet, of the rails of ladder 80 can then be placed into trough 12, then leaned into working position against working wall 90. Inclinometer 40 should be monitored throughout operation of ladder leveling device, and any leveling adjustments should be made in the safest possible manner.

CONCLUSION, RAMIFICATIONS, AND SCOPE

Thus the reader will see that the present invention provides a simple, practical device that can be easily used by one person.

While the above description contains many specificities, these should not be construed as limitations to the scope of the invention, but rather as an exemplification of one preferred embodiment thereof. Many other variations are possible, for example:

Frame 10, leg clamp 20, and all-terrain footing device 30 may be made of high-strength and/or colorful plastic, or other composite materials; or may fabricated from other mechanically or chemically fastened or hinged, extruded, molded or stamped metal components.

Leg clamp 20 may incorporate mechanical improvements which may help facilitate even quicker, individual operation.

Accordingly, the scope of the invention should be determined not by the embodiment illustrated, but by the appended claims and their legal equivalents.

I claim:

1. A ladder leveling device for use with a ladder having spaced side rails connected by spaced rungs, said leveling device comprising (a) a frame of relatively flat configuration forming a support platform, (b) said frame having an upwardly facing ladder-supporting work surface positioned within said frame, (c) said work surface incorporating vertical stopping elements to prevent the horizontal movement of a ladder lower end on said work surface, (d) said frame rigidly mounting a plurality of collars having engaging means to allow the vertical adjustability throughout the length of relative support elements, thereby providing means to level said frame over a fixed location of regular and irregular terrain, (e) said collars engaging said support elements such that axes thereof are in general symmetrical relation and oriented perpendicularly and adjacent to said frame's perimeter.

2. The ladder leveling device of claim 1, wherein said frame is of a triangular shape in a plane normal to said axes, wherein said collars are located at apices of said frame.

3. The ladder leveling device of claim 1 wherein said work surface of said frame is textured, thereby increasing traction on said work surface.

4. The ladder leveling device frame of claim 1 wherein said frame further includes an inclinometer.

5. A ladder leveling device according to claim 1, wherein (a) ground engaging elements are provided at the lower ends of each of said support elements, and (b) said ground engaging elements comprising alternatively operable foot elements for hard and soft terrain, respectively.

6. A ladder leveling device according to claim 5, wherein (a) one of said alternatively operable foot elements is fixed to said a support element, and the other of said alternatively operable foot elements is mounted for movement between operative and retracted positions.

7. A ladder leveling device of claim 1, wherein (a) said support elements are threaded, (b) said collars threadably engage said support elements, (c) said collars allow vertical adjustability throughout the threaded length of said support elements.

8. A ladder leveling device according to claim 1, wherein said collars are pivotably mounted to said frame.

* * * * *